US009793651B2

(12) United States Patent
An et al.

(10) Patent No.: US 9,793,651 B2
(45) **Date of Patent: *Oct. 17, 2017**

(54) BLIND MATING AND FLOATING RF CONNECTOR ASSEMBLY WITH LOW INTERMODULATION

(71) Applicant: CommScope Technologies LLC, Hickory, NC (US)

(72) Inventors: Hongjuan An, Suzhou (CN); Yujun Dai, Suzhou (CN); MuLan Huang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/262,409

(22) Filed: Sep. 12, 2016

(65) Prior Publication Data

US 2017/0070003 A1 Mar. 9, 2017

Related U.S. Application Data

(63) Continuation of application No. 14/878,632, filed on Oct. 8, 2015, now Pat. No. 9,444,186.

(30) Foreign Application Priority Data

Oct. 10, 2014 (CN) ..... 2014 2 0584495 U

(51) Int. Cl.
*H01R 13/64* (2006.01)
*H01R 13/631* (2006.01)
(Continued)

(52) U.S. Cl.
CPC ..... *H01R 13/6315* (2013.01); *H01R 24/40* (2013.01); *H01R 2103/00* (2013.01)

(58) Field of Classification Search
CPC .... H01R 912/91; H01R 13/28; H01R 13/631; H01R 13/6315; H01R 24/40; H01R 12/91
(Continued)

(56) References Cited

U.S. PATENT DOCUMENTS 4,227,765 A * 10/1980 Neumann ..... H01R 24/52 439/248
4,697,859 A * 10/1987 Fisher, Jr. ..... H01R 13/6315 439/246
(Continued)

FOREIGN PATENT DOCUMENTS

KR 101097281 12/2011

OTHER PUBLICATIONS

Extended European Search Report for corresponding EP Application No. 15189113.2, Dec. 16, 2015, 7 pages.

*Primary Examiner* — Chandrika Prasad
(74) *Attorney, Agent, or Firm* — Myers Bigel, P.A.

(57) ABSTRACT

The present invention discloses a blind mating and floating RF connector assembly with low intermodulation, comprising a first connecting device and a second connecting device, wherein the first connecting device comprises a first guide portion and the second connecting device comprises a second guide portion adapted for mating with the first guide portion, wherein the first connecting device has a slotted configuration and is provided, at an end, with a boss projecting radially outwards and the second connecting device is provided with a corresponding inner engaging groove being capable of radially abutting the boss, wherein the second connecting device comprises a fixed mount unit and a floating unit, the floating unit being capable of moving radially and axially relative to the fixed mount unit, in such a way that a plurality of pairs of the first connecting device and the second connecting device can be quickly connected simultaneously via a quick blind mating operation when the
(Continued)

first connecting device and the second connecting device are brought together, without necessarily making the first connecting device and the second connecting device be axially aligned precisely with each other. The present invention allows relative floating of connecting devices of a plurality of pairs of low-intermodulation RF connectors, allows simultaneous quick blind mating connection, and improves connecting efficiency and installation reliability.

13 Claims, 2 Drawing Sheets

(51) Int. Cl.
*H01R 24/40* (2011.01)
*H01R 103/00* (2006.01)

(58) Field of Classification Search
USPC ..... 439/246, 247, 248
See application file for complete search history.

(56) References Cited

U.S. PATENT DOCUMENTS

| | | | | |
|---|---|---|---|---|
| 4,789,351 | A | 12/1988 | Fisher, Jr. et al. | |
| 4,921,435 | A | 5/1990 | Kane | |
| RE34,430 | E * | 11/1993 | Mosquera | H01R 13/741 248/27.3 |
| 5,558,541 | A | 9/1996 | Botka | |
| 5,746,617 | A * | 5/1998 | Porter, Jr. | H01R 13/6315 439/248 |
| 5,885,107 | A * | 3/1999 | Sluss | H01R 13/4223 439/595 |
| 5,993,241 | A | 11/1999 | Olson | |
| 6,358,075 | B1 | 3/2002 | Tischner | |
| 6,773,286 | B1 | 8/2004 | Wu | |
| 8,894,431 | B2 * | 11/2014 | Tiberghien | F16L 37/56 439/247 |
| 9,444,186 | B2 * | 9/2016 | An | H01R 13/6315 |
| 2009/0068870 | A1 | 3/2009 | Mezhinsky | |
| 2010/0081307 | A1 | 4/2010 | Bopp | |

* cited by examiner

BLIND MATING AND FLOATING RF CONNECTOR ASSEMBLY WITH LOW INTERMODULATION

RELATED APPLICATION

This application claims priority under 35 U.S.C. §120 from U.S. patent application Ser. No. 14/878,632, filed Oct. 8, 2015, claims the benefit of and priority to Chinese Application No. ZL201420584495.2, filed Oct. 10, 2014, the disclosure of which is hereby incorporated herein in its entirety.

FIELD OF THE INVENTION

The present invention relates generally to an RF connector assembly for communication equipment, and particularly relates to a blind mating and floating RF connector assembly with low passive intermodulation (PIM).

BACKGROUND

Low-power RF connector assembles are often unsuitable for high-power applications because they have a relatively small interface and a limited transmission power. Furthermore, low-power RF connector assemblies are often unable to meet low passive intermodulation (PIM) requirements.

To promote reliable electric signal transmission and to provide low PIM, prior high-power RF connector assemblies with low intermodulation generally have a threaded connection arrangement with threaded male and female connectors, with the electrical connection/disconnection of the transmission unit being achieved by mechanical engagement and disengagement of the threaded connectors. These threaded connector assembly typically have low PIM, high vibration resistance, and high reliability.

Rigid connection is typically required between the male connector and the female connector of such a high-power RF connector assembly. The connectors should be precisely aligned with each other for rigid connection, which does not allow relative floating and which is time-consuming and cumbersome. As a result, a quick connection/disconnection operation cannot be achieved with such a known high-power RF connector assembly.

Moreover, such high-power RF connector assemblies ordinarily require relative high torque to ensure reliable contact. Consequently, special tools are often needed for the assembly process, as is sufficient space in which a technician can operate. These shortcomings render many known high-power RF connector assemblies unsuitable for a modular application which involves massive installation.

During the development of remote radio head technology, functional modules at the top of antenna towers have become more and more integrated, which requires that the modules be quickly connected and disconnected from each other while ensuring reliable installation and electric signal transmission. As such, it may be desirable to provide alternative high-power RF assemblies.

SUMMARY

A technical problem to be solved by the present invention is that a male connector and a female connector of the known high-power RF connector assembly with low intermodulation are connected in a rigid way and cannot float relative to each other, so that quick connection/disconnection cannot be realized.

To solve the above-mentioned problem of the prior art, an object of the present invention is to provide an RF connector assembly, which is provided with a floating unit and guiding means so that a male connector and a female connector of the connector assembly can be connected in a floating way, ane thus quick connection/disconnection can be realized.

In one aspect of the present invention, a blind mating and floating RF connector assembly with low intermodulation is provided, comprising a first connecting device and a second connecting device, wherein the first connecting device comprises a first guide portion and the second connecting device comprises a second guide portion adapted for mating with the first guide portion, wherein the first connecting device and the second connecting device can be guided by the first guide portion in cooperation with the second guide portion so as to be connected with each other, wherein the first connecting device has a slotted configuration and is provided, at an end, with a boss projecting radially outwards and the second connecting device is provided with a corresponding inner engaging groove being capable of radially abutting the boss, wherein the second connecting device comprises a fixed mount unit and a floating unit, the floating unit being movably disposed in the fixed mount unit and being capable of moving radially and axially relative to the fixed mount unit, in such a way that a plurality of pairs of the first connecting device and the second connecting device can be quickly connected simultaneously via a quick blind mating operation as guided by the first guide portion and the second guide portion when the first connecting device and the second connecting device are brought together, without necessarily making the first connecting device and the second connecting device be axially aligned precisely with each other.

In the context of this specification, "low intermodulation" means that the intermodulation value of the connector assembly is lower than −120 dBm.

In an embodiment of the invention, the fixed mount unit comprises a floating unit housing having a flange, and a floating unit opening, wherein the floating unit comprises a corresponding floating unit groove on the outer surface thereof, wherein the floating unit extends through the floating unit opening, with a radial clearance being formed between the floating unit opening of the fixed mount unit and the floating unit groove of the floating unit, so as to allow radial relative movement of the floating unit with respect to the fixed mount unit.

In an embodiment of the invention, the floating unit is provided with an elastic member receiving portion, with an elastic member being disposed in the elastic member receiving portion, wherein the elastic member allows the floating unit to move axially with respect to the fixed mount unit when an axial force is applied to the floating unit.

In an embodiment of the invention, the first connecting device is a female connector and the second connecting device is a male connector, wherein the female connector comprises a female connector main body, the female connector main body comprises an inner cavity, and the first guide portion comprises a first beveled guide portion formed on the front end of the inner cavity of the female connector main body, wherein the male connector comprises a male connector outer contact member, the floating unit groove is formed on the outer surface of the male connector outer contact member, and the second guide portion comprises a second beveled guide portion mating with the first beveled guide portion, formed on the outer side of the front end of the male connector outer contact member.

In an embodiment of the invention, the female connector further comprises a female connector outer contact member located in the inner cavity of the female connector main body, and the first guide portion further comprises an annular cavity for receiving the male connector outer contact member, formed between the wall of the inner cavity of the female connector main body and the female connector outer contact member, and wherein the second guide portion further comprises a third beveled guide portion mating with the periphery of the front end of the female connector outer contact member, formed on the inner side of the front end of the male connector outer contact member.

In an embodiment of the invention, a stepped stop portion is provided on the outer periphery of the male connector outer contact member, at the inner side of the elastic member receiving portion, and the outer diameter of the stepped stop portion is greater than the diameter of the floating unit opening of the floating unit housing.

In an embodiment of the invention, the boss is formed at an end of the female connector outer contact member with the slotted configuration, the inner engaging groove is formed on the inner surface of the male connector outer contact member, and the boss snugly contacts the inner engaging groove radially.

In an embodiment of the invention, the female connector further comprises a female connector inner contact member and a female connector insulator, the female connector inner contact member and the female connector insulator being disposed in the inner cavity of the female connector main body, the female connector insulator being disposed between the female connector inner contact member and the female connector main body, for supporting and positioning the female connector inner contact member.

In an embodiment of the invention, the male connector outer contact member comprises an inner cavity, and the male connector further comprises a male connector inner contact member and a male connector insulator disposed in the inner cavity of the male connector outer contact member, the male connector insulator being located between the male connector inner contact member and the male connector outer contact member, supporting the male connector inner contact member and partitioning the male connector inner contact member from the male connector outer contact member, so as to position the male connector inner contact member with respect to the male connector outer contact member.

In an embodiment of the invention, the male connector further comprises a male connector rear member, wherein an insertion opening is formed at the rear part of the male connector outer contact member, in communication with the inner cavity of the male connector outer contact member, and wherein the male connector rear member extends into the inner cavity of the male connector outer contact member through the insertion opening.

In an embodiment of the invention, the insertion opening extends along the radial direction of the male connector outer contact member.

In an embodiment of the invention, a spring can be disposed around the outer periphery of the front end of the stepped stop portion of the male connector outer contact member, and the spring abuts the male connector outer contact member at one end and abuts an inner wall face of the floating unit housing at the other end in a free state.

Advantages of embodiments of the present invention may include: the blind mating and floating RF connector assembly with low intermodulation of the present invention has a floating capability within a certain range; the blind mating and floating RF connector assembly with low intermodulation of the present invention has adaptability to certain misalignment of the connectors; the blind mating and floating RF connector assembly with low intermodulation of the present invention allows simultaneously connection of a plurality of pairs of high-power RF connectors with low-intermodulation via quick blind mating connection; by use of the blind mating and floating RF connector assembly with low intermodulation of the present invention, the connecting efficiency and installation reliability are improved, reliable transmission of electric signals are ensured, and the low-intermodulation distortion requirement is met.

A clearance is provided between the annular floating unit groove on the male connector outer contact member and the floating unit opening of the floating unit housing, so that the male connector has a radial floating freedom due to the clearance; and once the male and female connectors are connected, an axial floating freedom relative to the floating unit housing is obtained because the spring can be compressed.

According to the present invention, once the male connector rear member is installed onto the male connector outer contact member, they can freely move or float axially and radially in the floating unit housing, which can be fixed on the antenna panel, under the action of axial and radial external forces, forming a floating construction.

A beveled guide portion and an inner engaging groove can be provided on the outer side and inner side of the male connector outer contact member of the present invention. When being connected, the pair of connectors are guided by the beveled portions so as to come into a coaxial state, then the boss on the end of the slotted outer contact member of the female connector is compressed radially so as to be entirely engaged in the inner engaging groove on the front end of the male connector outer contact member, and tightly contacts the inner engaging groove on the front end of the male connector outer contact member under the action of a radial elastic pressure, so as to obtain a high radial contact compression force and ensure good intermodulation.

A stepped stop portion and an annular floating unit groove can be provided on the outer periphery of the male connector outer contact member of the present invention. The outer diameter of the stepped stop portion is greater than that of the floating unit opening of the floating unit housing, thereby providing a reliable support for the engaged connectors, which greatly extends the service life of the spring, unlike a conventional connector assembly which merely relies on the elasticity of the spring or compresses the spring to an fatigued extent so as to ensure adequate engagement of the pair of connectors.

A male connector rear member can be provided at the rear of the male connector outer contact member of the present invention. The male connector rear member has two functions: on the one hand, it can be used for the installation of a cable, and on the other hand, it can limit the relative position of the male connector outer contact member and the floating unit housing.

As another aspect, embodiments of the invention are directed to a blind mating and floating RF connector assembly with low intermodulation, comprising: a first connector comprising a first guide portion and a second connector comprising a second guide portion adapted for mating with the first guide portion. The first connector and the second connector can be guided by the first guide portion in cooperation with the second guide portion so as to be connected with each other. The first connector is provided, at an end, with a boss and the second connector is provided with a corresponding inner engaging groove being capable of radially abutting the boss. The second connector comprises a fixed mount unit and a floating unit, the fixed mount unit including a hole, the floating unit extending into the hole. A biasing member engages the first connector and the second connector and applies axial pressure thereto such that the floating unit is movable radially and axially relative to the fixed mount unit.

As a further aspect, embodiments of the invention are directed to a blind mating and floating RF connector assembly, comprising: a pair of first connectors, each comprising a first guide portion, the first connectors fixed relative to each other; and a pair of second connectors, each comprising a second guide portion adapted for mating with the first guide portion. Each first connector can be guided by its respective first guide portion in cooperation with the second guide portion of a respective second connector so as to be connected with each other as a mated pair. Each first connector is provided, at an end, with a boss and each mating second connector is provided with a corresponding inner engaging groove being capable of radially abutting a respective boss. A fixed mount unit includes a plurality of holes, with a respective second connector extending into each hole. A respective biasing member engages each mated first connector and each second connector and applies axial pressure thereto such that each second connector is movable radially and axially relative to the fixed mount unit, thereby facilitating blind mating of the first connectors with the second connectors.

Advantage(s) of the present invention can be achieved by one or more aspects of the present invention and/or by one or more features (combination thereof) of the present invention.

BRIEF DESCRIPTION OF THE DRAWINGS

Embodiments of the present invention will be described in detail by way of example with reference to the accompanying drawings, in which.

DETAILED DESCRIPTION OF THE EMBODIMENTS

Some embodiments of the present invention will be exemplarily described below with reference to the accompanying drawings. It should be understood that the illustrated embodiments are not limiting but merely exemplary.

Figure 1:
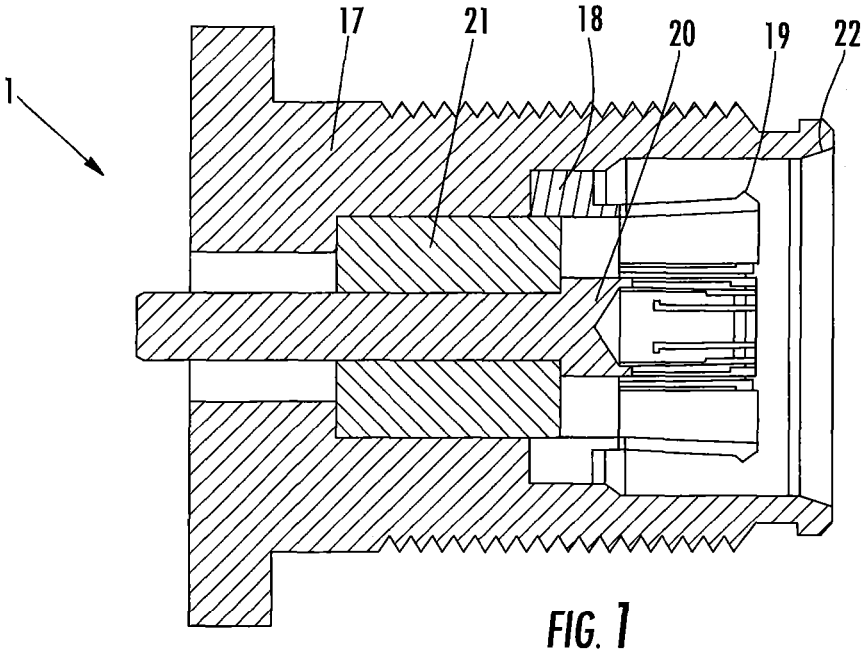
FIG. 1 schematically shows the configuration of a female connector according to an embodiment of the present invention.

FIG. 1 schematically shows the configuration of a female connector 1 according to an embodiment of the present invention.

As shown in FIG. 1, the female connector 1 comprises a female connector main body 17. An inner cavity is formed in the female connector main body 17. The female connector 1 further comprises a female connector outer contact member 18 disposed in the inner cavity of the female connector main body 17. A female connector inner contact member 20 is also disposed in the inner cavity of the female connector main body 17. A female connector insulator 21 is also disposed in the female connector main body for the purpose of supporting and positioning the contact members 17, 20. The female connector insulator 21 is disposed between the female connector inner contact member 20 and the female connector main body 17. The female connector insulator 21 may also be used, together with the female connector main body, for supporting and positioning the female connector outer contact member 18.

As shown in FIG. 1, a first beveled guide portion 22 is formed at the front end of the female connector main body 17 (which is the end of the female connector facing a male connector when the female connector is connected to the male connector), and can be used for guiding a male connector outer contact member to contact the female connector outer contact member. In one embodiment, the female connector outer contact member 18 has a slotted configuration, and a boss 19 is radially formed at an end thereof, and the boss 19 can be used for radially abutting a corresponding inner engaging groove on the male connector outer contact member.

Figure 2:
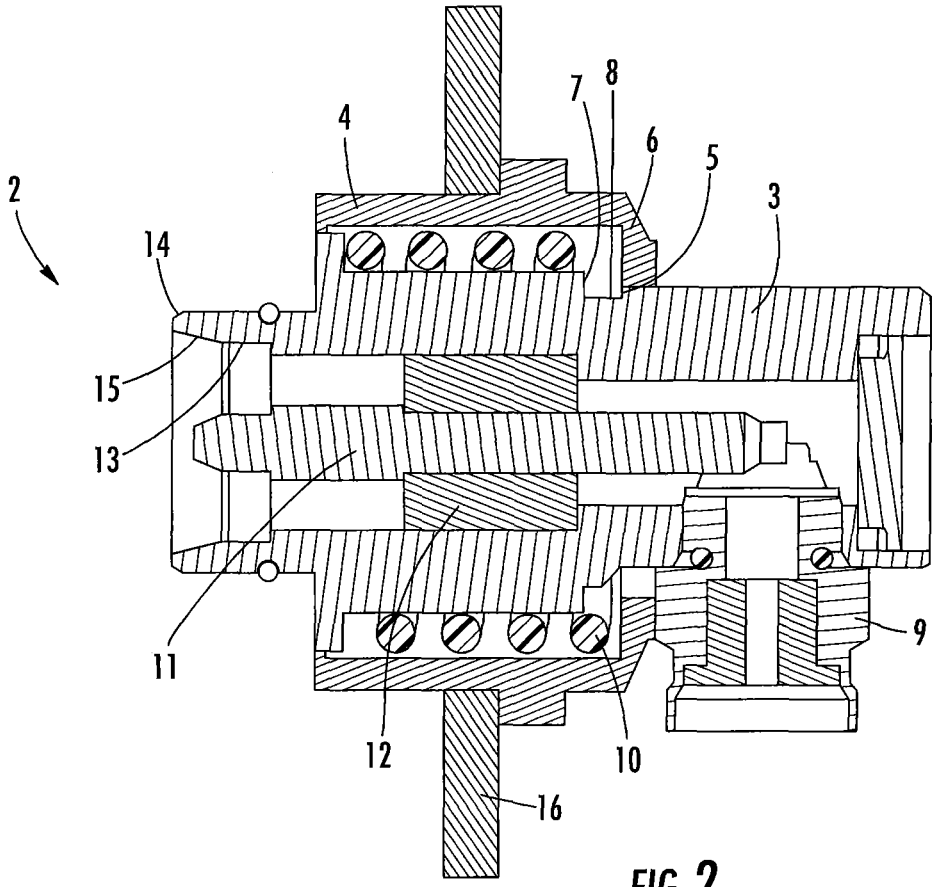
FIG. 2 schematically shows the configuration of a male connector according to an embodiment of the present invention.

FIG. 2 schematically shows the configuration of a male connector according to an embodiment of the present invention. The male connector 2 comprises a fixed mount unit and a floating unit movably disposed in the fixed mount unit. Particularly, the fixed mount unit comprises a floating unit opening, and the floating unit comprises a corresponding floating unit groove located on the outer surface of the floating unit. A radial clearance (spacing) is formed between the floating unit opening of the fixed mount unit and the floating unit groove of the floating unit, so as to allow radial relative movement of the floating unit with respect to the fixed mount unit.

In one embodiment, as shown in FIG. 2, the fixed mount unit can be composed of a floating unit housing 4 with a flange which can be used for fixing the connector to an antenna panel 16. In one embodiment, the floating unit housing 4 can be fixedly mounted to the antenna panel through mounting holes of the flange. The floating unit housing 4 is provided with a floating unit opening 5 adapted to the outer periphery of the male connector outer contact member of the floating unit, and the floating unit is inserted into the floating unit opening 5.

As shown in FIG. 2, the floating unit comprises a male connector outer contact member 3, a male connector inner contact member 11, a male connector insulator 12, a male connector rear member 9 and an elastic member such as spring 10.

In one embodiment, the male connector outer contact member 3 is substantially cylindrical, and a male connector inner cavity is formed in the male connector outer contact member 3. The male connector inner contact member 11 and the male connector insulator 12 are disposed in the male connector inner cavity, wherein the male connector insulator 12 is disposed between the male connector inner contact member 11 and the male connector outer contact member 3 to space apart the male connector inner contact member 11 from the male connector outer contact member 3, and supports the male connector inner contact member 11 to properly position the male connector inner contact member 11 relative to the male connector outer contact member 3. Particularly, positioning shoulders are formed on the male connector inner contact member 11 and the male connector outer contact member 3, respectively, which abut the male connector insulator 12 for properly positioning the male connector inner contact member 11 with respect to the male connector outer contact member 3.

An elastic member receiving portion is formed on the outer surface of the male connector outer contact member 3, for receiving the elastic member such as spring 10.

A male connector rear member insertion opening is formed in the rear part of the male connector outer contact member 3, and is in communication with the male connector inner cavity. The male connector rear member 9 can extend into the male connector inner cavity through the insertion opening. A cable can be connected through the male connector rear member. In addition, insertion of the male connector rear member 9 into the insertion opening at the rear part of the male connector outer contact member 3 can help to properly position the male connector outer contact member 3 with respect to the floating unit housing 4. In one embodiment, the insertion opening is in the radial direction of the male connector contact members, and has an axis that is perpendicular to the axis of the male connector inner cavity.

Particularly, a second beveled guide portion 14 is formed on the outer side of the front end of the male connector outer contact member 3 (which is the end of the male connector facing the female connector when the male connector is connected to the female connector). A third beveled guide portion 15 and an inner engaging groove 13 are formed on the inner side of the front end of the male connector outer contact member 3. The first beveled guide portion 22 on the female connector main body and the second beveled guide portion 14 and the third beveled guide portion 15 on the male connector outer contact member 3 can guide the male connector outer contact member 3 into the annual cavity of the female connector when the male connector is connected to the female connector, which helps with blind mating of the connector assembly.

The elements of the male connector can be mounted in the following mounting sequence: the elastic member such as spring 10 is disposed around the outer periphery of the male connector outer contact member 3, and the elastic member and the male connector outer contact member 3 together are passed through the floating unit opening 5 of the floating unit housing 4, and then the male connector rear member 9 is screwed into the rear part of the male connector outer contact member 3 and is retained therein, and thus the installation is completed.

Once the male connector rear member 9 is installed onto the male connector outer contact member 3, they can freely move or float axially and radially in the floating unit housing 4, which can be fixed on the antenna panel, under the action of axial and radial external forces, forming a floating construction.

Particularly, an annular floating unit groove 8 is formed on the outer surface of the male connector outer contact member 3, and is in clearance fit with the floating unit opening 5 of the floating unit housing 4, so that the male connector can have a radial floating freedom as result of the clearance between the annular floating unit groove 8 and the floating unit opening 5. When the male connector is inserted in the female connector, freedom of axial flotation relative to the floating unit housing can be obtained by compressing the elastic member such as spring 10. Thus, such an assembly of male and female connectors can allow simultaneous quick blind mating of a plurality of pairs of high-power low-intermodulation connectors between an RRH and an antenna.

Since the high-power connector assembly has a larger contact force as compared with a small-power connector assembly, a relatively large force needs to be applied to connect its male connector with its female connector. For this reason, particularly, in one embodiment of the present invention, a stepped stop portion 7 may be further formed on the outer periphery of the male connector outer contact member 3. The stepped stop portion 7 is located at the inner side of the elastic member receiving portion on the male connector outer contact member 3, for the purpose of limiting the axial flotation and thus preventing any impact force generated during connection of the male connector and the female connector from damaging the spring, thereby protecting the elastic member such as spring 10.

The spring 10 can be disposed around the outer periphery of the front end of the stepped stop portion on the male connector outer contact member. The spring can abut the male connector outer contact member 3 at one end and abut an inner wall face 6 of the floating unit housing at the other end in a free state.

Figure 3:
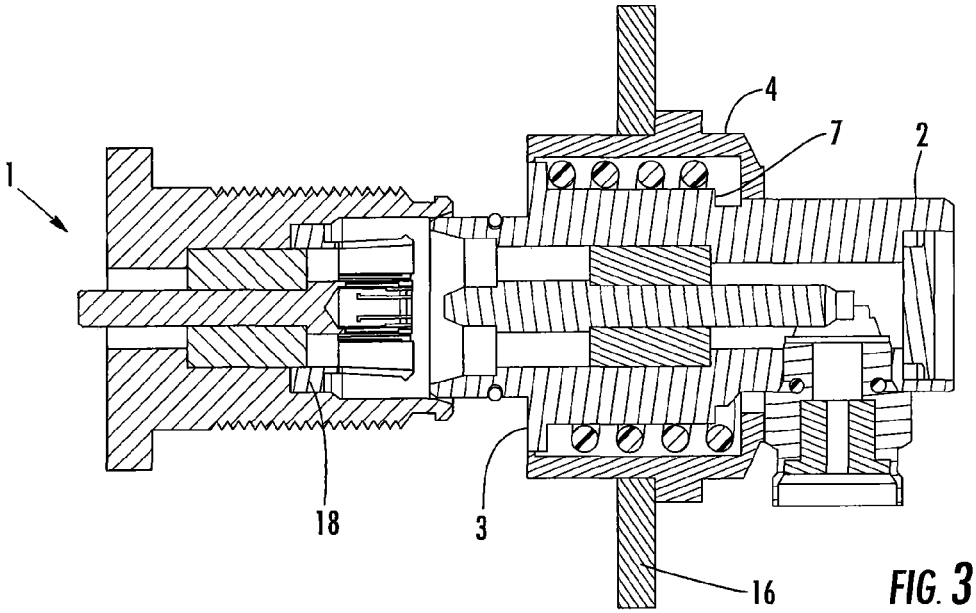
FIG. 3 schematically shows the configuration of the connector assembly according to an embodiment of the present invention at the beginning of the connection process.
Figure 4:
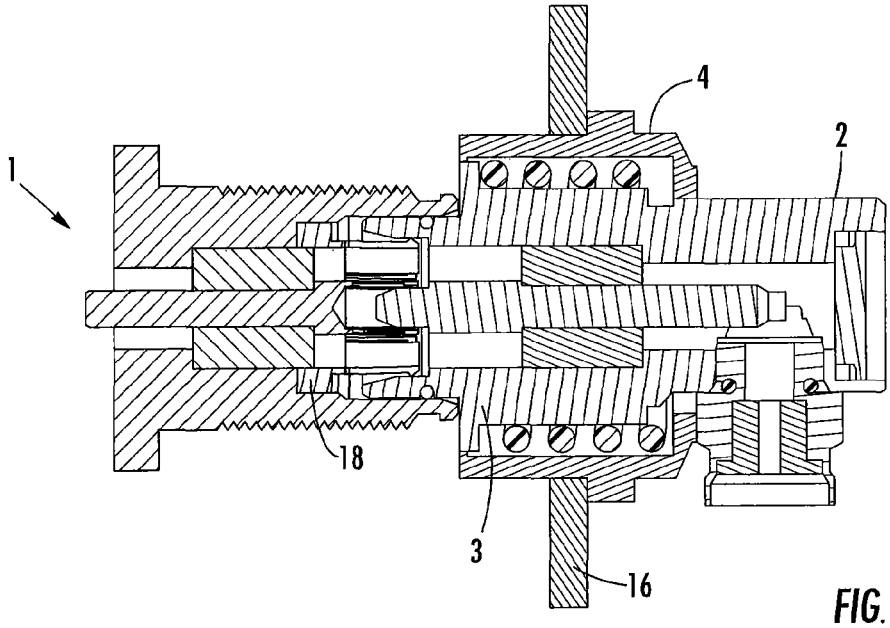
FIG. 4 schematically shows the configuration of the connector assembly in a connected state according to an embodiment of the present invention.

FIGS. 3 and 4 show the connecting process of the female connector 1 and the male connector 2.

As shown in FIG. 3, the male connector 2 is in a free state before it is connected, and the male connector rear member 9 abuts the rear end face of the floating unit housing 4 due to the action of the spring force. Once an axial external force is exerted, the female connector 1 starts to connect the male connector. Initially, the first beveled guide portion 22 on the front end of the female connector 1 contacts the second beveled guide portion 14 on the front end of the male connector 2. The centralization of the pair of connectors (male and female connector pair) is adjusted as guided by the beveled guide portions. As such, at the beginning of connection, the offset of the male connector (which might be offset in a free state) is corrected, rendering the female connector and the male connector coaxial and correcting the radial offset, so that the male and female connectors are centered . Under the action of a continuous axial external force, the elastic member such as spring 10 is compressed. As the external force is continuously exerted, the front end face of the female connector main body 17 abuts the front end face of the male connector outer contact member 3, and at the same time the female connector outer contact member 18 retracts radially due to elasticity. Accordingly, the boss 19 provided at the end of the female connector outer contact member 18 is entirely engaged into the inner engaging groove 13 on the front end of the male connector outer contact member 3, and tightly and reliably contacts the engaging groove 13 under the radial elastic compression. As such, the female connector 1 and the male connector 2 are connected with each other.

After the female connector and the male connector are connected, the external force is withdrawn, and under the action of a restoring force of the elastic member such as spring 10 itself, the floating unit of the male connector 2 brings the female connector 1 back to the initial position, and the floating unit of the male connector 2 automatically returns to an initial state by floating axially and radially. When a reverse axial external force is applied to the female connector 1, the slotted outer contact member 18 of the female connector 1 retracts radially, releasing the end boss 19 from the male connector 2 against the contact force of the engaging groove 13, and the male connector 2 restores to the initial position after the external force is withdrawn.

According to embodiments of the present invention, the radial and axial allowance and freedom of movement enable the connectors to have adaptability to offset when the male and female connector are connected, improving the connection reliability, ensuring accurate electrical engagement of the inner and outer contact members, and providing continuous reliable electrical contact. Furthermore, the boss at the end of the slotted outer contact member of the female connector tightly contacts the inner engaging groove at the front end of the male connector outer contact member radially due to the elasticity of the fingers of the boss, resulting in a high radial contact pressure and good intermodulation property. Such a connector assembly can comprise a plurality of pairs of male connectors and female connectors, allowing simultaneous quick blind mating of a plurality of pairs of high-power low-intermodulation connectors between an RRH and an antenna.

In an alternative embodiment of the present invention, as an alternative to and similar to the case in which the male connector comprises a fixed mount unit and a floating unit, the female connector can comprise a fixed mount unit and a floating unit movably disposed in the fixed mount unit, to allow the floating unit of the female connector to move radially and axially to a certain extent relative to the fixed mount unit, for facilitating blind mating of the male connector and the female connector.

According to the present invention, "low intermodulation" means that the intermodulation value is lower than −120 dBm.

In one embodiment of the present invention, a blind mating and floating RF connector assembly with low intermodulation comprises a first connecting device and a second connecting device, wherein the first connecting device comprises a first guide portion and the second connecting device comprises a second guide portion adapted for mating with the first guide portion, wherein the first connecting device and the second connecting device can be guided by the first guide portion in cooperation with the second guide portion so as to be connected with each other, wherein the second connecting device comprises a fixed mount unit and a floating unit, the floating unit being movably disposed in the fixed mount unit and being capable of moving radially and axially relative to the fixed mount unit, in such a way that the first connecting device and the second connecting device can be quickly connected via a quick blind mating operation as guided by the first guide portion and the second guide portion when the first connecting device and the second connecting device are brought together, without necessarily making the first connecting device and the second connecting device be axially aligned precisely with each other.

The connector assembly according to the present invention can be connected and disconnected quickly and directly, is easy to operate and does not need a large operation space. It is advantageous in convenient and reliable installation and good performance. Moreover, since the axial and radial tolerance/clearance in the present invention are both accommodated by the male connector, the female connector does not need to be adapted, and thus the male connector can be used together with a standard female connector. The assembly has good compatibility.

Some embodiments of the present invention have been described exemplarily with reference to the accompanying drawings. It should be understood that the specific structure and process described in the section "Detailed Description of the Embodiments " are merely exemplary, but not limiting. Moreover, a person of ordinary skill in the art to which the present invention pertains can combine various technical features described above in various possible ways to form new technical solutions or make other modifications thereto within the scope of the present invention.

What is claimed:

1. A blind mating and floating RF connector assembly with low intermodulation, comprising:

a first connecting device comprising a first guide portion;

a second connecting device comprising a second guide portion adapted for mating with the first guide portion;

wherein the first connecting device and the second connecting device can be guided by the first guide portion in cooperation with the second guide portion so as to be connected with each other;

wherein the first connecting device is provided, at an end, with a slotted boss projecting radially outwards and the second connecting device is provided with a corresponding inner engaging groove being capable of radially abutting the boss;

wherein the second connecting device comprises a fixed mount unit and a floating unit, the floating unit being mounted in the fixed mount unit to be movable radially and axially relative to the fixed mount unit.

2. The RF connector assembly according to claim 1, wherein the fixed mount unit comprises a floating unit housing having a flange, and a floating unit opening, wherein the floating unit comprises a corresponding floating unit groove on the outer surface thereof, wherein the floating unit extends through the floating unit opening, with a radial clearance being formed between the floating unit opening of the fixed mount unit and the floating unit groove of the floating unit, so as to allow radial relative movement of the floating unit with respect to the fixed mount unit.

3. The RF connector assembly according to claim 2, wherein the floating unit is provided with an elastic member receiving portion, with an elastic member being disposed in the elastic member receiving portion, wherein the elastic member allows the floating unit to move axially with respect to the fixed mount unit when an axial force is applied to the floating unit.

4. The RF connector assembly according to claim 1, wherein the first connecting device is a female connector and the second connecting device is a male connector, wherein the female connector comprises a female connector main body, the female connector main body comprises an inner cavity, and the first guide portion comprises a first beveled guide portion formed on the front end of the inner cavity of the female connector main body, wherein the male connector comprises a male connector outer contact member, the floating unit groove is formed on the outer surface of the male connector outer contact member, and the second guide portion comprises a second beveled guide portion mating with the first beveled guide portion, formed on the outer side of the front end of the male connector outer contact member.

5. The RF connector assembly according to claim 4, wherein the female connector further comprises a female connector outer contact member located in the inner cavity of the female connector main body, and the first guide portion further comprises an annular cavity for receiving the male connector outer contact member, formed between the wall of the inner cavity of the female connector main body and the female connector outer contact member, and wherein the second guide portion further comprises a third beveled guide portion mating with the periphery of the front end of the female connector outer contact member, formed on the inner side of the front end of the male connector outer contact member.

6. The RF connector assembly according to claim 5, wherein a stepped stop portion is provided on the outer periphery of the male connector outer contact member, at the inner side of the elastic member receiving portion, and the outer diameter of the stepped stop portion is greater than the diameter of the floating unit opening of the floating unit housing.

7. The RF connector assembly according to claim 6, wherein the boss is formed at an end of the female connector outer contact member with the slotted configuration, the inner engaging groove is formed on the inner surface of the male connector outer contact member, and the boss snugly contacts the inner engaging groove radially.

8. The RF connector assembly according to claim 6, wherein the female connector further comprises a female connector inner contact member and a female connector insulator, the female connector inner contact member and the female connector insulator being disposed in the inner cavity of the female connector main body, the female connector insulator being disposed between the female connector inner contact member and the female connector main body, for supporting and positioning the female connector inner contact member.

9. The RF connector assembly according to claim 6, wherein the male connector outer contact member comprises an inner cavity, and the male connector further comprises a male connector inner contact member and a male connector insulator disposed in the inner cavity of the male connector outer contact member, the male connector insulator being located between the male connector inner contact member and the male connector outer contact member, supporting the male connector inner contact member and partitioning the male connector inner contact member from the male connector outer contact member, so as to position the male connector inner contact member with respect to the male connector outer contact member.

10. The RF connector assembly according to claim 9, wherein the male connector further comprises a male connector rear member, wherein an insertion opening is formed at the rear part of the male connector outer contact member, in communication with the inner cavity of the male connector outer contact member, and wherein the male connector rear member extends into the inner cavity of the male connector outer contact member through the insertion opening.

11. The RF connector assembly according to claim 10, wherein the insertion opening extends along the radial direction of the male connector outer contact member.

12. A blind mating and floating RF connector assembly with low intermodulation, comprising:

a first connector comprising a first guide portion;

a second connector comprising a second guide portion adapted for mating with the first guide portion;

wherein the first connector and the second connector can be guided by the first guide portion in cooperation with the second guide portion so as to be connected with each other;

wherein the first connector is provided, at an end, with a boss and the second connector is provided with a corresponding inner engaging groove being capable of radially abutting the boss;

wherein the second connector comprises a fixed mount unit and a floating unit, the fixed mount unit including a hole, the floating unit extending into the hole;

and wherein a biasing member engages the first connector and the second connector and applies axial pressure thereto such that the floating unit is movable radially and axially relative to the fixed mount unit.

13. A blind mating and floating RF connector assembly, comprising:

a pair of first connectors, each comprising a first guide portion, the first connectors fixed relative to each other;

a pair of second connectors, each comprising a second guide portion adapted for mating with the first guide portion;

wherein each first connector can be guided by its respective first guide portion in cooperation with the second guide portion of a respective second connector so as to be connected with each other as a mated pair;

wherein each first connector is provided, at an end, with a boss and each mating second connector is provided with a corresponding inner engaging groove being capable of radially abutting a respective boss;

wherein a fixed mount unit includes a plurality of holes, with a respective second connector extending into each hole;

and wherein a respective biasing member engages each mated first connector and each second connector and applies axial pressure thereto such that each second connector is movable radially and axially relative to the fixed mount unit, thereby facilitating blind mating of the first connectors with the second connectors.

* * * * *